US007952453B2

(12) United States Patent
Chen et al.

(10) Patent No.: US 7,952,453 B2
(45) Date of Patent: May 31, 2011

(54) STRUCTURE DESIGN FOR MINIMIZING ON-CHIP INTERCONNECT INDUCTANCE

(75) Inventors: Hsien-Wei Chen, Tainan County (TW); Hsueh-Chung Chen, Taipei County (TW); Shin-Puu Jeng, Hsinchu County (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 0 days.

(21) Appl. No.: 12/759,836

(22) Filed: Apr. 14, 2010

(65) Prior Publication Data

US 2010/0194501 A1 Aug. 5, 2010

Related U.S. Application Data

(62) Division of application No. 11/688,903, filed on Mar. 21, 2007, now Pat. No. 7,705,696.

(51) Int. Cl.
*H01P 3/08* (2006.01)

(52) U.S. Cl. ..... 333/238; 333/246

(58) Field of Classification Search ..... 333/238, 333/246

See application file for complete search history.

(56) References Cited

U.S. PATENT DOCUMENTS

| | | | | |
|---|---|---|---|---|
| 4,233,579 | A | 11/1980 | Carlson et al. | |
| 6,144,268 | A | 11/2000 | Matsui et al. | |
| 6,985,055 | B2 | 1/2006 | Minami | |
| 7,088,204 | B2 * | 8/2006 | Kanno | 333/238 |

FOREIGN PATENT DOCUMENTS

JP 2004357011 A 12/2004

OTHER PUBLICATIONS

CN Office Action mailed Jun. 26, 2009, cited in parent.
English Abstract of JP2004357011, pub. Dec. 16, 2004.
English language, machine translation (generated by Japan Patent Office Web site) of published application JP2004-357011, published Dec. 16, 2004.

* cited by examiner

*Primary Examiner* — Benny Lee
(74) *Attorney, Agent, or Firm* — Thomas | Kayden

(57) ABSTRACT

A semiconductor device comprising a signal line and ground line is disclosed. The signal line comprises an opening and at least a portion of the ground line is in the opening in the signal line.

5 Claims, 8 Drawing Sheets

STRUCTURE DESIGN FOR MINIMIZING ON-CHIP INTERCONNECT INDUCTANCE

CROSS REFERENCE TO RELATED APPLICATIONS

This application is a Divisional of U.S. patent application Ser. No. 11/688,903, filed on Mar. 21, 2007, now U.S. patent 7,705,696, the entirety of which is/are incorporated by reference herein.

FIELD OF THE INVENTION

The invention relates to semiconductor devices, and more particularly to comprising semiconductor device structures minimizing or eliminating on-chip interconnect inductance.

BACKGROUND OF THE INVENTION

FIG. 1 illustrates a conventional cable 10 capable of carrying an electronic signal. The cable 10 comprises a core 12 which may be a solid metal such as copper. A concentric insulator layer 14, typically comprising a non-electrically conductive material such as a plastic, overlies the core 12. A concentric ground layer 16 over the insulator 14 serves as a ground path and an electromagnetic interference shield.

FIG. 2 illustrates a portion of a conventional semiconductor device comprising a first flat signal line 18, a second flat signal line 20 and a first flat ground line 22 positioned between the first signal line 18 and the second signal line 20. A second flat ground line 24 is provided on the outside edge of the first flat signal line 18. A third flat ground line 26 is provided on the outside edge of the second flat signal line 20. An insulator (not shown) may be positioned between the signal lines 18 and 20, and the ground lines 22, 24, 26.

FIG. 3 illustrates a portion of a conventional semiconductor device comprising a flat signal line 28 and an underlying flat ground layer 30. An insulator (not shown) may be interposed between the flat signal line 28 and the flat ground layer 30.

FIG. 4 illustrates a portion of a conventional semiconductor device comprising a flat signal line 32 and a first flat ground line 34 on one side of the flat signal line 32 and a second flat ground line 36 on the other side. A first flat ground layer 38 underlies the flat signal line 32, first flat ground line 34 and second flat ground line 36. An insulator (not shown) may be positioned between the signal line 32, the ground lines 34, and 36 and flat ground layer 38.

FIG. 5 illustrates a portion of a conventional semiconductor device comprising a first flat ground layer 38 underlying a first flat signal line 32, a first flat ground line 34 adjacent one side of the flat signal line 32 and a second flat ground line 36 adjacent the opposite side of the flat signal line 32. A second flat ground layer 40 overlies the flat signal line 32, first flat ground line 34 and second flat ground line 36.

SUMMARY OF THE INVENTION

Semiconductor structures capable of minimizing or eliminating on-chip interconnect inductance are provided. One embodiment of the invention comprises a semiconductor device comprising a signal line and a first ground line. The signal line comprises an opening wherein at least a portion of the first ground line is in the opening.

In another embodiment of the invention, a signal line and a first ground line are on the same plane.

In another embodiment of the invention, a opening extends completely through the signal line.

In another embodiment of the invention, a signal line has a first outer side face and a second outer side face spaced apart by a distance equal to or less than 12 μm.

Another embodiment of the invention further comprises a dielectric material separating the signal line from the ground line.

In another embodiment of the invention, a dielectric material is air.

In another embodiment of the invention, a dielectric material is silicon dioxide.

In another embodiment of the invention, a dielectric material has a dielectric constant ranging from 1 to 3.6.

Another embodiment of the invention further comprises a second opening with a portion of a second ground line in the opening.

Another embodiment of the invention further comprises a first plug connected to the first ground line and the first plug electrically connected to a first bond pad.

Another embodiment of the invention further comprises a second plug connected to the first ground line and the second plug electrically connected to a second bond pad.

Another embodiment of the invention further comprises a first redistribution trace electrically connected to the first bond pad and the first plug.

Another embodiment of the invention further comprises a second redistribution trace electrically connected to the second bond pad and to the second plug.

In another embodiment of invention, a portion of the first ground line comprises a top face, bottom face, first side face, opposite second side face, first end face and second end face.

In another embodiment of invention, a signal line surrounds at least four of the top face, bottom face, first side face, opposite second side face, first end face and second end face of the portion of the first ground line.

In another embodiment of invention, a signal line surrounds each of the top face, bottom face, first side face, opposite second side face, first end face and second end face of the portion of the first ground line.

In another embodiment of invention, a portion of the second ground line comprises a top face, bottom face, first side face, opposite second side face, first end face and second end face.

In another embodiment of invention, a signal line surrounds at least four of the top face, bottom face, first side face, opposite second side face, first end face and second end face of the portion of the second ground line.

In another embodiment of invention, a signal line surrounds all of the top face, bottom face, first side face, opposite second side face, first end face, and second end face of the portion of the second ground line.

In another embodiment of invention, a signal line surrounds each of the top face, bottom face, first side face, opposite second side face, first end face and second end face of the portion of the second ground line.

Another embodiment of the invention further comprises a dielectric separating the signal line from the portion of the first ground line and the portion of the second ground line.

Another embodiment of the invention further comprises a first plug connected to the portion of the first ground line and wherein the signal line surrounds the first plug.

Another embodiment of the invention further comprises a dielectric separating the first plug from the signal line.

Another embodiment of the invention further comprises a first bond pad electrically connected to the first plug.

Another embodiment of the invention further comprises a first redistribution trace electrically connecting the first bond pad to the first plug.

Another embodiment of the invention further comprises a second plug electrically connecting the portion of a first ground line and wherein the signal line surrounds the second plug.

Another embodiment of the invention further comprises a dielectric separating the second plug from the signal line.

Another embodiment of the invention further comprises a second bond pad electrically connected to the second plug.

Another embodiment of the invention further comprises a second redistribution trace electrically connecting the second bond pad to the second plug.

Another embodiment of the invention comprises a semiconductor device comprising a signal line and at least a first and a second ground line, the signal line having at least a first opening and a second opening. At least a portion of the first ground line is in the first opening and a portion of the second ground line is in the second opening.

Other embodiments of the invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

The following description of various embodiment(s) of the invention is exemplary in nature and is in no way intended to limit the invention, its application, or uses.

Figure 1:
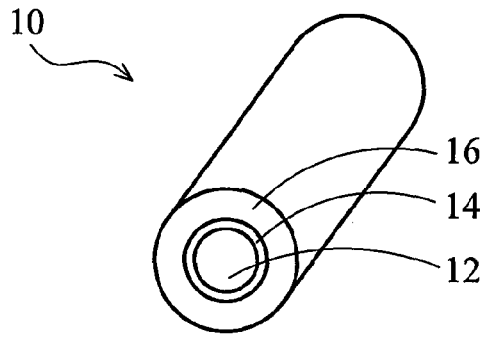
FIG. 1 ( PRIOR ART )
FIG. 1 illustrates a conventional cable.
Figure 2:
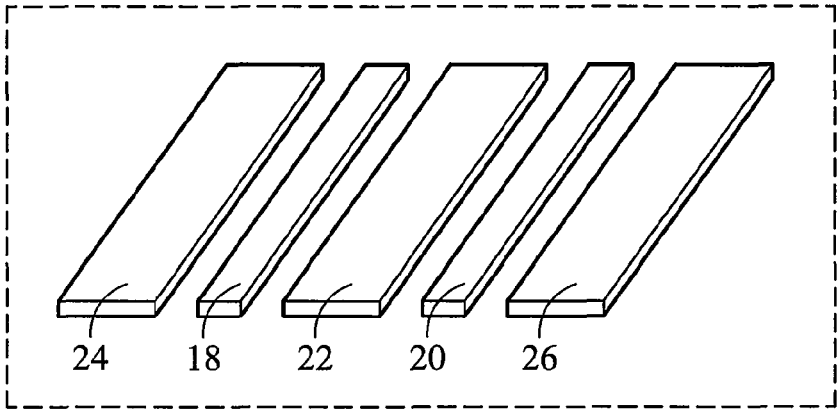
FIG. 2 ( PRIOR ART )
FIG. 2 illustrates a portion of a conventional semiconductor device.
Figure 3:
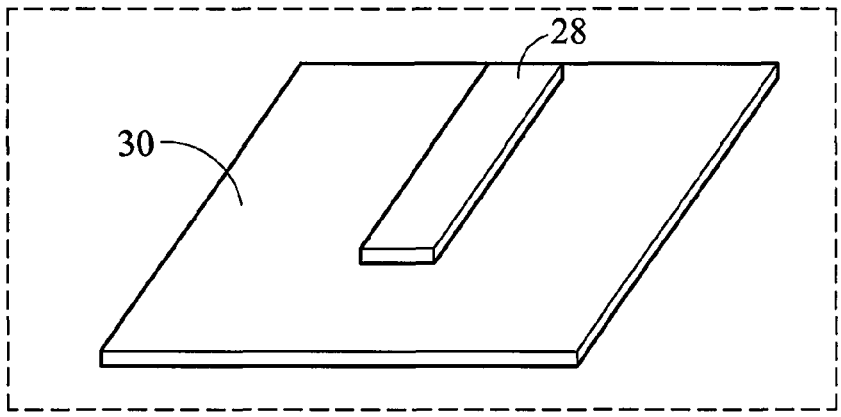
FIG. 3 ( PRIOR ART )
FIG. 3 illustrates a portion of a conventional semiconductor device.
Figure 4:
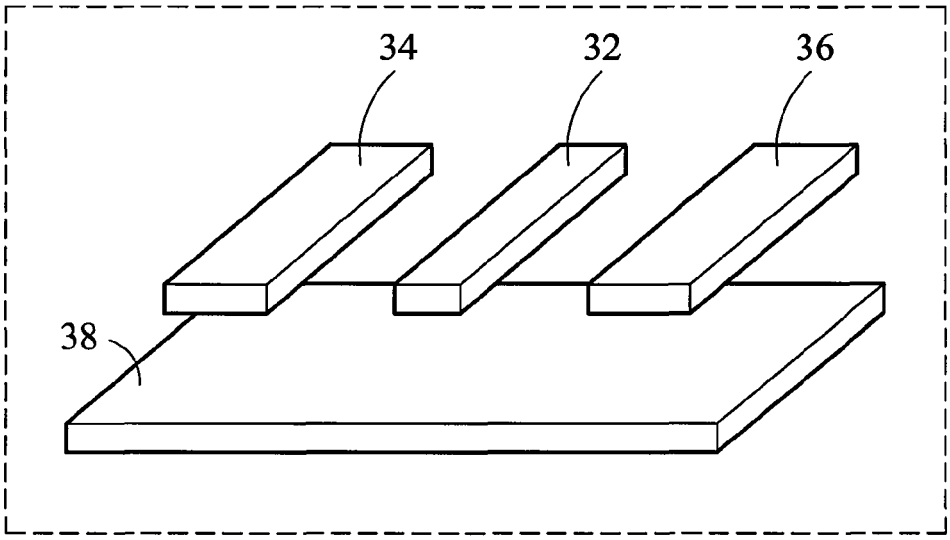
FIG. 4 ( PRIOR ART )
FIG. 4 illustrates a portion of a conventional semiconductor device.
Figure 5:
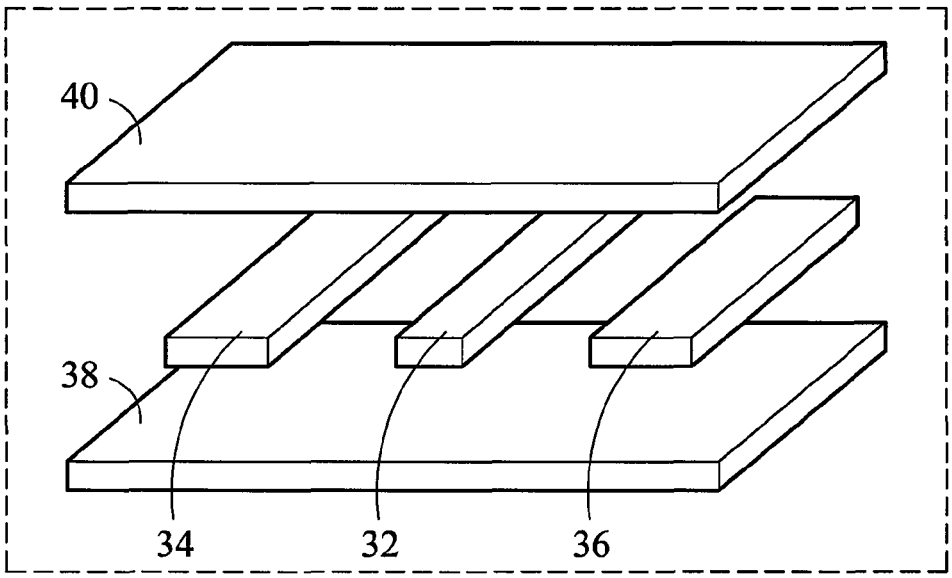
FIG. 5 ( PRIOR ART )
FIG. 5 illustrates a portion of a conventional semiconductor device.
Figure 6A:
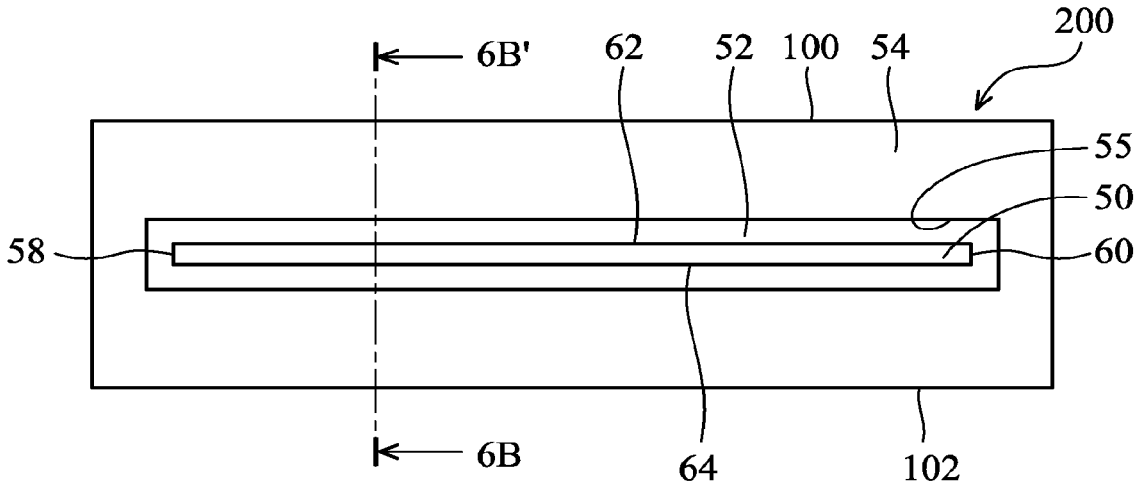
FIG. 6A illustrates a top view of one embodiment of a semiconductor device.
Figure 6B:
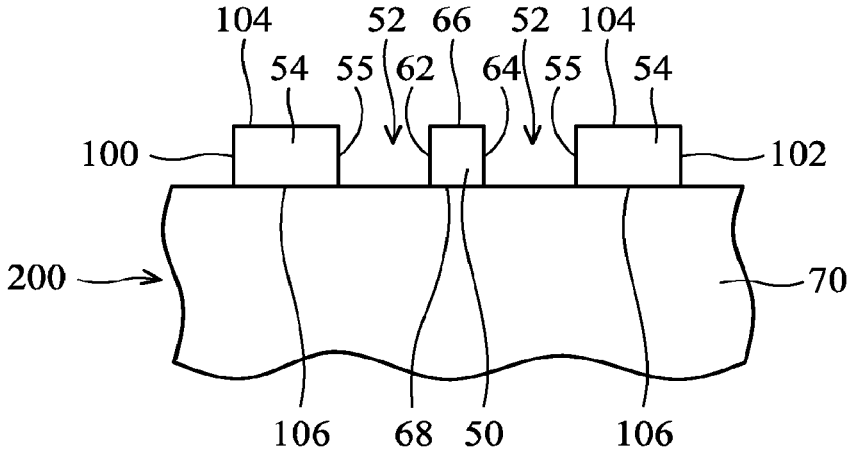
FIG. 6B is a sectional view taken along line 6B-6B' of FIG. 6A.

FIG. 6A illustrates a top view of a portion of a semiconductor device 200. FIG. 6B is a sectional view taken along line 6B-6B' of FIG. 6A. Referring to FIG. 6A and FIG. 6B, the semiconductor device 200 comprises a portion of a ground line 50 positioned in an opening 55 formed in a signal line 54. The signal line 54 may be utilized to carry an electronic signal, such as a video, graphic, audio, data signal or the like. The portion of the ground line 50 comprises a first end face 58 and an opposite second end face 60, as shown in FIG. 6A. The portion of the ground line 50 also comprises a first side 62, a second opposite side 64, a top face 66 (as shown in FIG. 6B), and a bottom face 68, as seen in FIG. 6B.

Figure 7A:
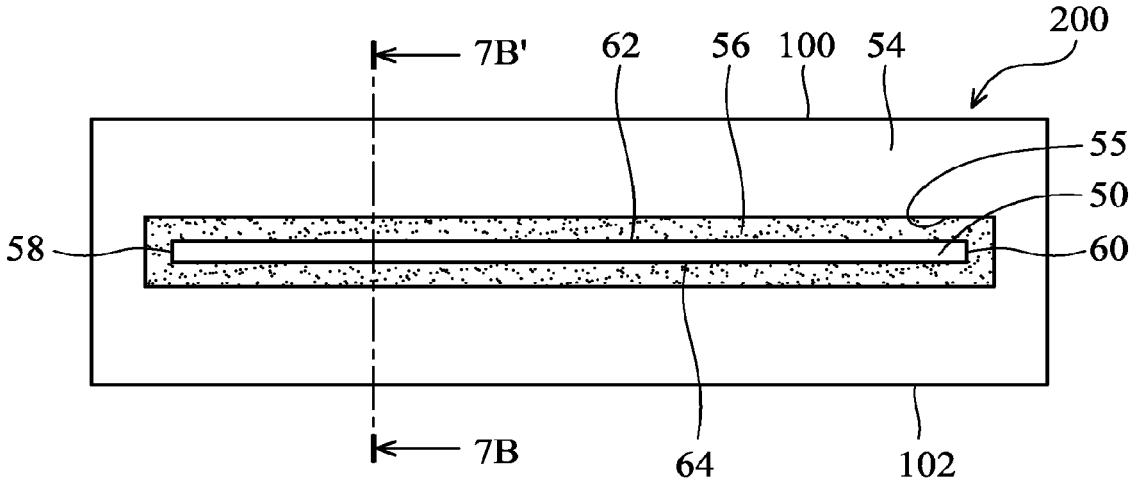
FIG. 7A illustrates a top view of an alternative embodiment of a semiconductor device.
Figure 7B:
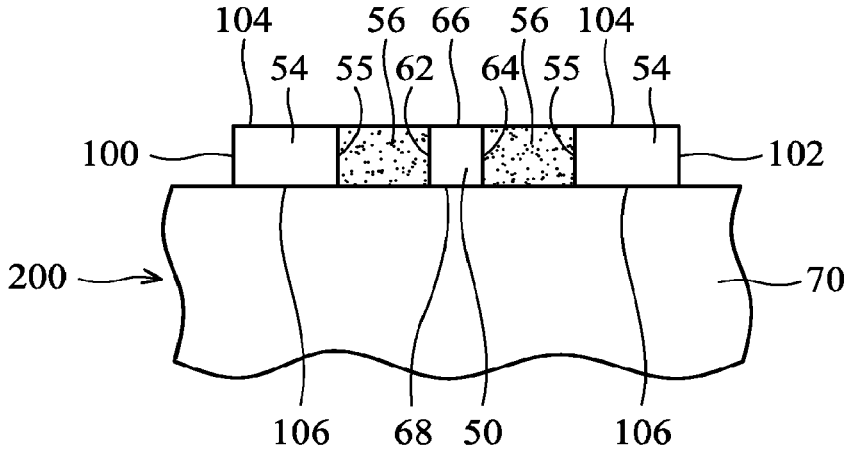
FIG. 7B is a sectional view taken along line 7B-7B' of FIG. 6A.

FIG. 7A illustrates a top view of an alternative embodiment of a semiconductor device. FIG. 7B is a sectional view taken along line 7B-7B' of FIG. 7A. Note that the same or similar elements use the same reference numbers as that of the previously described embodiment and may not be all described herein. Referring now to FIGS. 7A and 7B, the semiconductor device 200 comprises a portion of a ground line 50 positioned in an opening 55 formed in a signal line 54. The signal line 54 may be utilized to carry an electronic signal, such as a video, graphic, audio, data signal or the like. The signal line 54 comprises a top face 104, comprising a substantially flat portion, and a bottom face 106, as shown in FIG. 7B. The signal line 54 comprises a first outer side 100 and an opposite second outer side 102. The signal line 54 and the portion of the ground line 50 may be formed on a first intermetal dielectric 70, as shown in FIG. 7B. The opening is filled with dielectric materials, such that the signal line 54 and the portion of the ground line 50 is separated by a solid dielectric 56, such as silicon dioxide.

Figure 8A:
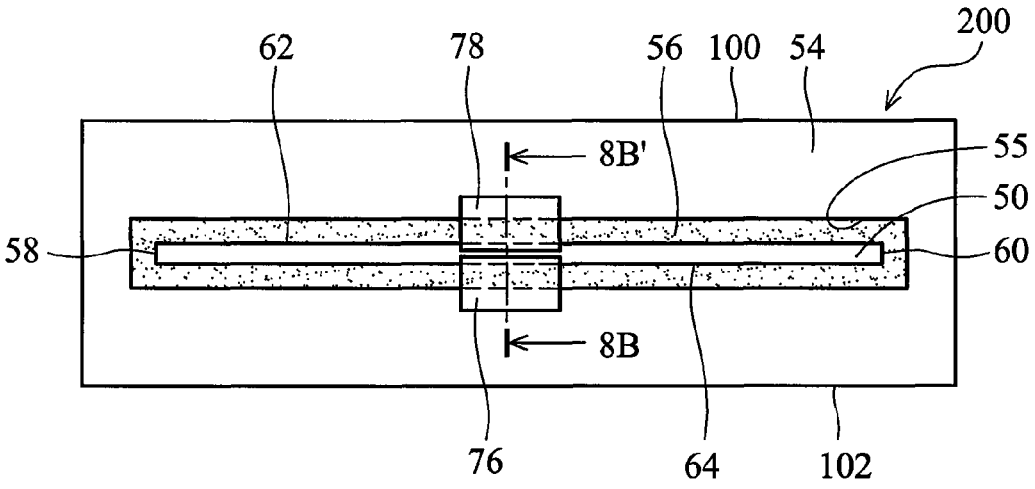
FIG. 8A illustrates a plan view of a further alternative embodiment of a semiconductor device.
Figure 8B:
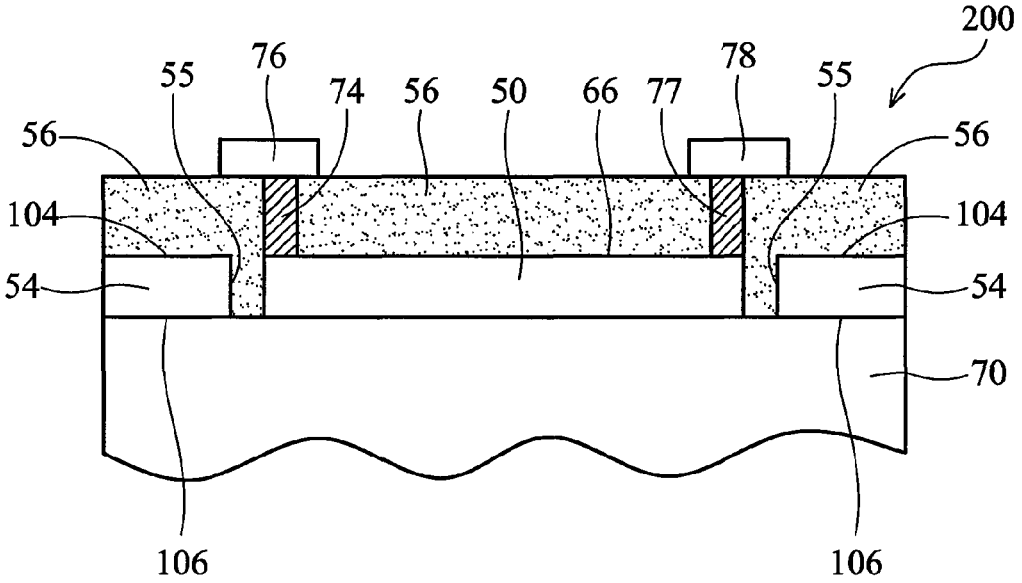
FIG. 8B is a sectional view taken along line 8B-8B' of FIG. 8A.

FIG. 8A illustrates a plan view of a further alternative embodiment of a semiconductor device. FIG. 8B is a sectional view taken along line 8B-8B' of FIG. 8A. Note that the same or similar elements use the same reference numbers as that of The previously described embodiment and may not be all described herein. Referring now to FIGS. 8A and 8B, the semiconductor device 200 comprises a portion of a ground line 50 positioned in an opening 55 formed in a signal line 54. The signal line 54 may be utilized to carry an electronic signal, such as a video, graphic, audio, data signal or the like. The signal line 54 comprises a top face 104, comprising a substantially flat portion, and a bottom face 106, as shown in FIG. 8B.

Figure 9A:
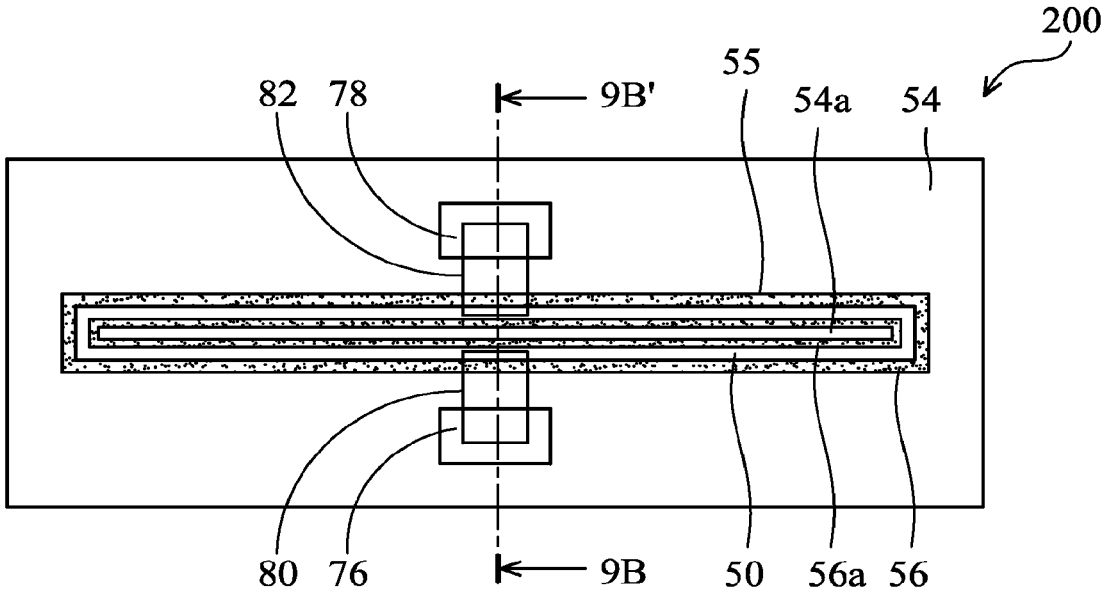
FIG. 9A illustrates a plan view of a yet alternative embodiment of a semiconductor device.
Figure 9B:
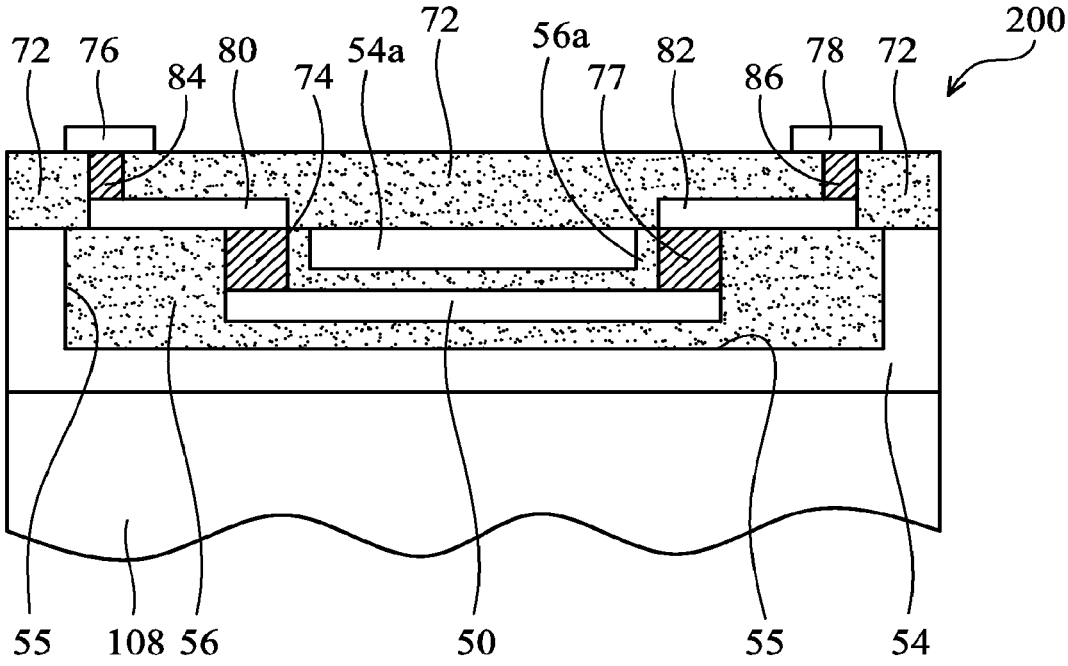
FIG. 9B is a sectional view taken along line 9B-9B' of FIG. 9A.

FIG. 9A illustrates a plan view of a yet alternative embodiment of a semiconductor device. FIG. 9B is a sectional view taken along line 9B-9B' of FIG. 9A. Note that the same or similar elements use the same reference numbers as that of the previously described embodiment and may not be all described herein. Referring now to FIGS. 9A and 9B, a first signal line 54 is disposed on a first intermetal dielectric layer 108 (FIG. 9B) with an opening 55 filled with a dielectric layer 56. A ground line 50 is over the first signal line 54 with the dielectric layer 56 interposed therebetween. In addition, a second signal line 54*a* is over the ground line 50 with another dielectric layer 56*a* interposed therebetween. Note that the dielectric layers 56 separates the first signal lines 54 and the ground line 50, and the dielectric layers 56*a* separates the second signal line 54*a* and the ground line 50. A first redistribution trace 80 (also see FIG. 9A) is connected to the first ground via 74 and to a third ground via 84 extending from the first redistribution trace 80 through a second intermetal dielectric layer 72, as shown in FIG. 9B.

Figure 10:
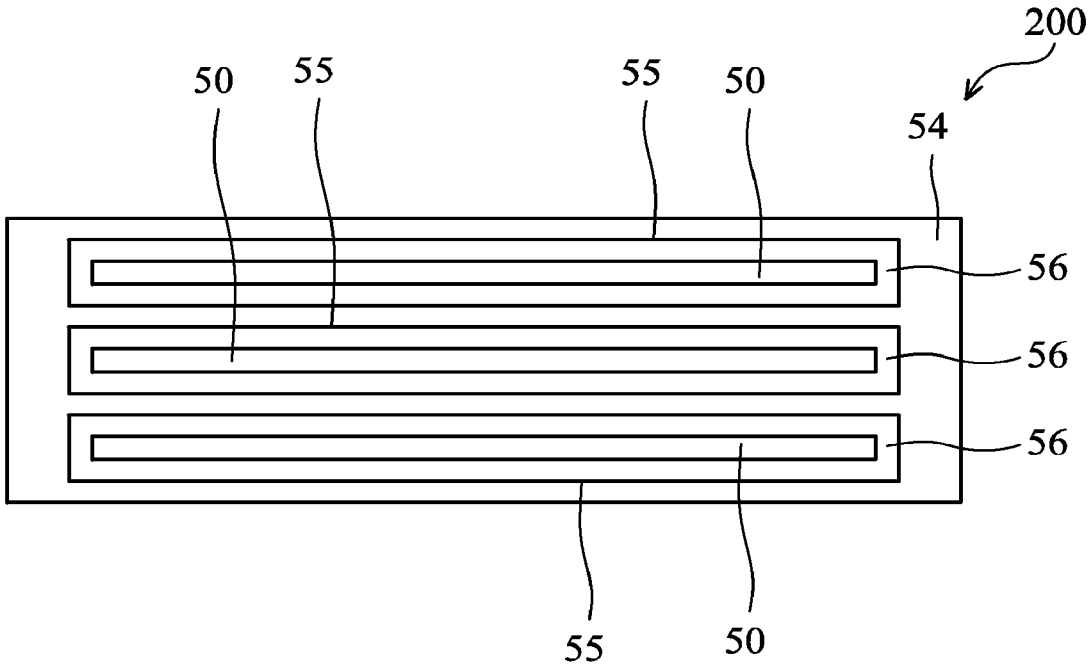
FIG. 10 shows a top view of another embodiment of a semiconductor device.

FIG. 10 illustrates a top view of a portion of a semiconductor device 200 comprising a plurality of openings 55 formed in a signal line 54 and a portion of a ground line 50 received in each of the openings 55. An insulator 56 separates the portion of the ground line 50 and the signal line 54.

Figure 11:
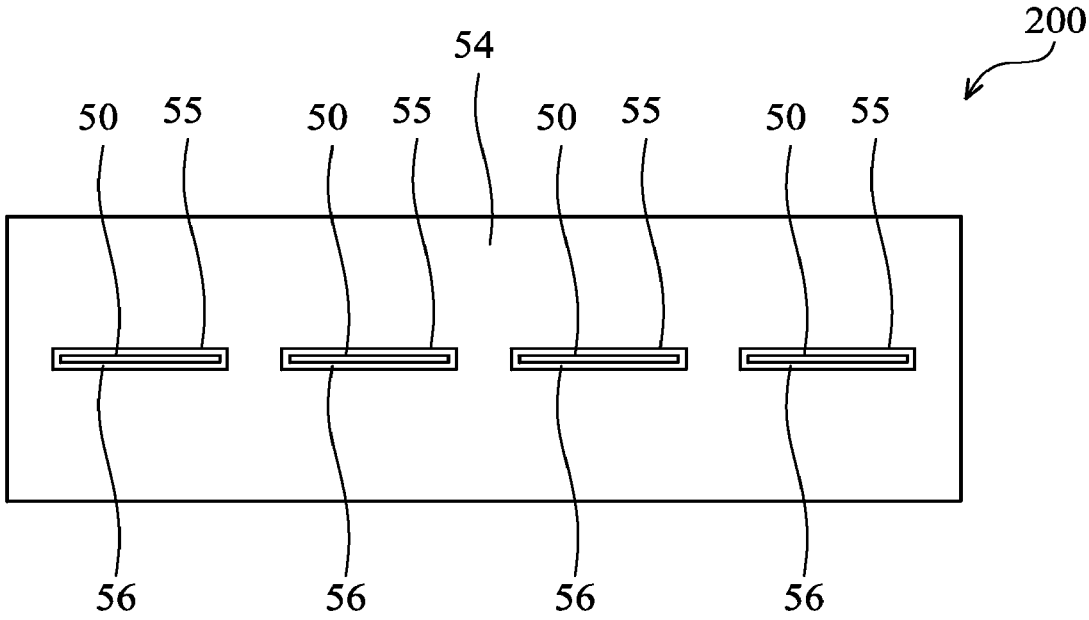
FIG. 11 illustrates a top view of yet another embodiment of a semiconductor device.

FIG. 11 is a top view of a portion of a semiconductor device 200 comprising a plurality of portions of a ground line 50 each received in an opening 55 formed in a signal line 54. Again, an insulator 56, such as silicon dioxide, separates the portion of the ground line 50 from the signal line 54.

Figure 12:
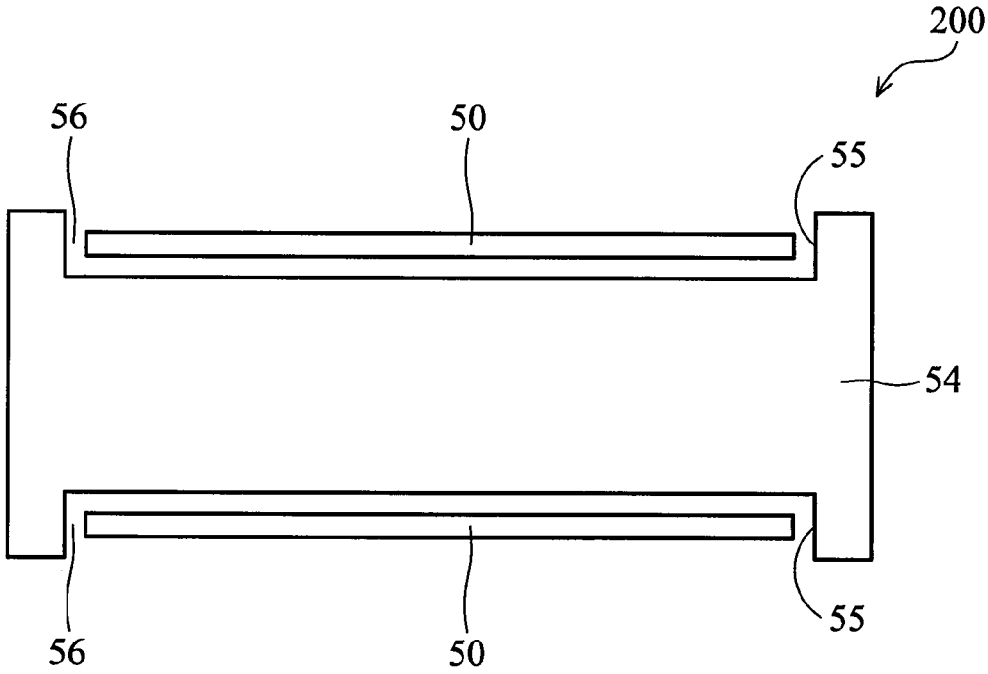
FIG. 12 shows a top view of further another embodiment of a semiconductor device.

FIG. 12 illustrates a top view of a portion of a semiconductor device 200 comprising openings 55 formed in a signal line 54 and a portion of a ground line 50 received in each of the openings 55 of another embodiment of the invention. In this embodiment, the openings are neighboring opposite sidewalls of the signal line 54. An insulator 56 separates the portion of the ground line 50 and the signal line 54.

Figure 13:
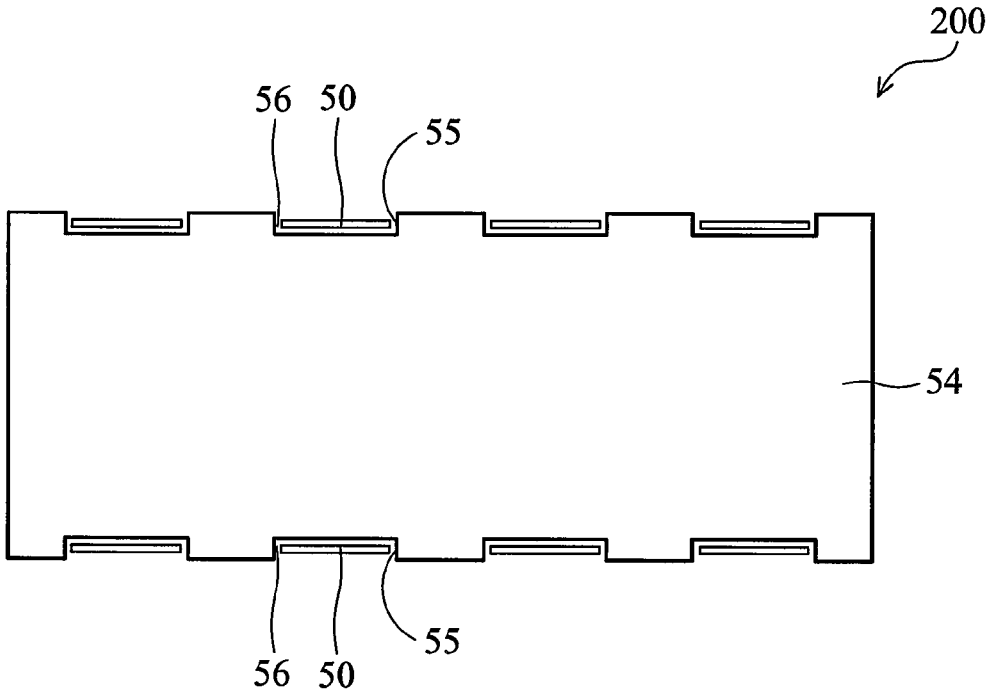
FIG. 13 illustrates a top view of yet further another embodiment of a semiconductor device.

FIG. 13 is a top view of a portion of a semiconductor device 200 comprising a plurality of portions of a ground line 50 each received in an opening 55 formed in a signal line 54 of further another embodiment of the invention. Again, the openings 55 are neighboring two opposite sidewalls of the signal line 54, and an insulator 56, such as silicon dioxide, separates the portion of the ground line 50 from the signal line 54.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A semiconductor device, comprising:

an first interconnect dielectric layer;

a first signal line disposed on the interconnect dielectric layer, wherein the signal line comprises an opening filled with first dielectric layer;

a ground line disposed over the first signal line and in the opening with the first dielectric layer interposed therebetween; and a second signal line disposed over the ground line with a second dielectric layer interposed therebetween.

2. The semiconductor device as claimed in claim 1, further comprising a first ground via disposed in the first dielectric layer and connected to the ground line.

3. The semiconductor device as claimed in claim 2, further comprising a redistribution trace connecting the first ground via and a bond pad.

4. The semiconductor device as claimed in claim 3, wherein the redistribution trace connects the first ground via and the bond pad by a second ground via.

5. The semiconductor device as claimed in claim 4, wherein the second ground via is disposed in a second interconnect dielectric layer disposed on the second signal line.

* * * * *